US012612838B2

(12) United States Patent
Nguyen et al.

(10) Patent No.: US 12,612,838 B2
(45) Date of Patent: Apr. 28, 2026

(54) SELECTIVE WELL BARRIER BOTTOM, SYSTEM, AND METHOD

(71) Applicant: Baker Hughes Oilfield Operations LLC, Houston, TX (US)

(72) Inventors: Tuan Nguyen, Pearland, TX (US); James Scott Trahan, Magnolia, TX (US)

( * ) Notice: Subject to any disclaimer, the term of this patent is extended or adjusted under 35 U.S.C. 154(b) by 0 days.

(21) Appl. No.: 18/640,344

(22) Filed: Apr. 19, 2024

(65) Prior Publication Data

US 2025/0327369 A1 Oct. 23, 2025

(51) Int. Cl.
*E21B 33/129* (2006.01)

(52) U.S. Cl.
CPC ..... *E21B 33/1294* (2013.01); *E21B 2200/05* (2020.05)

(58) Field of Classification Search
CPC . E21B 33/1294; E21B 33/129; E21B 33/1295
See application file for complete search history.

(56) References Cited

U.S. PATENT DOCUMENTS 2,133,462 A * 10/1938 Mcmanis ..... E21B 33/12 166/126
2,607,424 A * 8/1952 Taylor ..... E21B 33/1265 166/134
2,822,875 A * 2/1958 Brown ..... E21B 33/1294 166/138
3,139,140 A * 6/1964 Brown ..... E21B 33/12955 166/134
3,410,348 A * 11/1968 Page ..... E21B 33/1295 166/134
4,842,082 A 6/1989 Springer
5,305,828 A * 4/1994 White ..... E21B 33/1294 166/120
11,248,435 B1 2/2022 Yue et al.
2015/0337621 A1 11/2015 Melenyzer
2019/0257193 A1 8/2019 Telfer et al.
2020/0018131 A1* 1/2020 Telfer ..... E21B 33/129
2021/0054697 A1* 2/2021 Dokhon ..... E21B 33/03
2021/0062597 A1 3/2021 Yuan et al.

OTHER PUBLICATIONS

Notification of Transmittal of the International Search Report and the Written Opinion of the International Searching Authority, or the Declaration; PCT/US2025/025297; Mail Date: Aug. 1, 2025; 10 pages.

* cited by examiner

*Primary Examiner* — David Carroll
(74) *Attorney, Agent, or Firm* — Baker Hughes Company

(57) ABSTRACT

A selective well barrier/bottom, including a housing, a slip disposed in the housing, a drive bar in contact with the slip, a biaser between the housing and the drive bar, a seal on the housing to radially seal with a tubular radially outwardly of the housing, and a flow bypass arrangement to facilitate flow past the seal. A borehole configuration to convert a hydraulically settable downhole tool to a mechanically settable downhole tool, the arrangement including a seal and a flow bypass arrangement configured to allow fluid flow to bypass the seal. A method for setting a tool in a borehole including fitting the selective well barrier/bottom to the tool, and setting the tool with one of applied hydraulic pressure against the seal or set down weight against the selective well barrier/bottom. A wellbore system, including a borehole in a subsurface formation, a selective well barrier/bottom, disposed within the borehole.

15 Claims, 10 Drawing Sheets

SELECTIVE WELL BARRIER BOTTOM, SYSTEM, AND METHOD

BACKGROUND

In the resource recovery and fluid sequestration industries tools often need to be actuated for myriad tasks. Generally, tools are electrically, hydraulically or mechanically actuated. Hydraulic and mechanical actuations are the most common forms and require that pressure can be built or a hard stop can be found for those actuations, respectively. Where either of those conditions are harder to come by, for example the bottom of the well is far away, the well has routes for fluid loss making pressure more difficult or more costly to achieve, etc., actuation of the tools is less efficient than it could be. Nevertheless, the art has been struggling with these issues for decades. The art would well receive alternative technology that addresses these issues.

SUMMARY

An embodiment of a selective well barrier/bottom, including a housing, a slip operably disposed in the housing, a drive bar in operable contact with the slip, a biaser disposed between the housing and the drive bar, a seal disposed on the housing to radially seal with a tubular radially outwardly of the housing, and a flow bypass arrangement disposed to facilitate flow past the seal.

An embodiment of a borehole configuration to convert a hydraulically settable downhole tool to a mechanically settable downhole tool, the arrangement including a seal disposed to span an annular space about the configuration and contact a radially outwardly disposed tubular, a flow bypass arrangement configured to allow fluid flow through the configuration and to bypass the seal.

An embodiment of a method for setting a tool in a borehole including fitting the selective well barrier/bottom to the tool, and setting the tool with one of applied hydraulic pressure against the seal or set down weight against the selective well barrier/bottom.

An embodiment of a wellbore system, including a borehole in a subsurface formation, a selective well barrier/bottom, disposed within the borehole.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
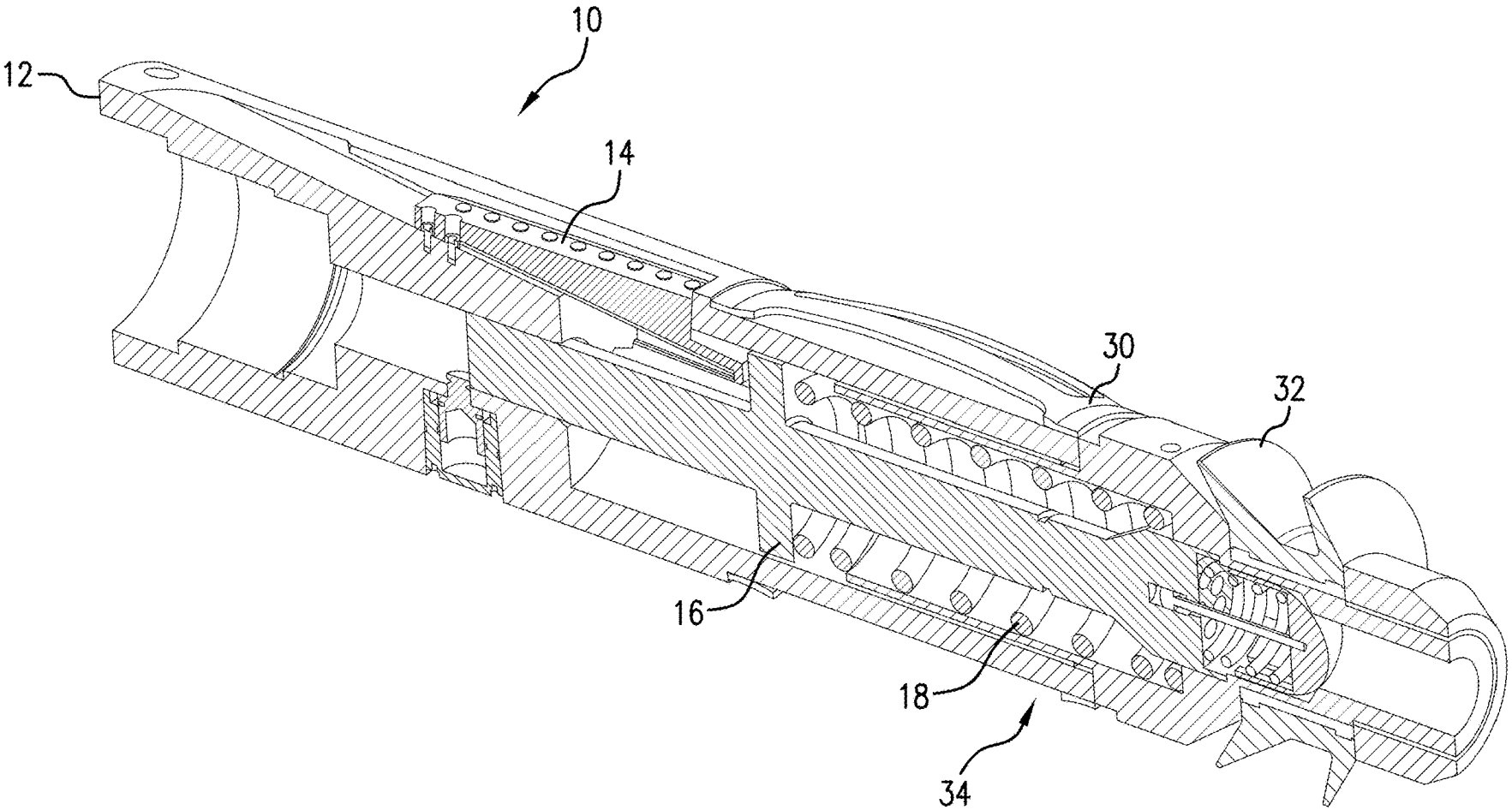
FIG. 1 is a perspective cross sectional view of a selective well barrier/bottom as disclosed herein.

Referring to FIG. 1, a selective well barrier/bottom 10 is illustrated in perspective cross section. It is to be understood that although the terms "selective well barrier/bottom" are used throughout this document to describe the configuration disclosed, the configuration also is a conversion enabler for tools that employ hydraulic valves to be constructed without those valves and set mechanically instead through set down weight on the selective well barrier/bottom 10.

Figure 2:
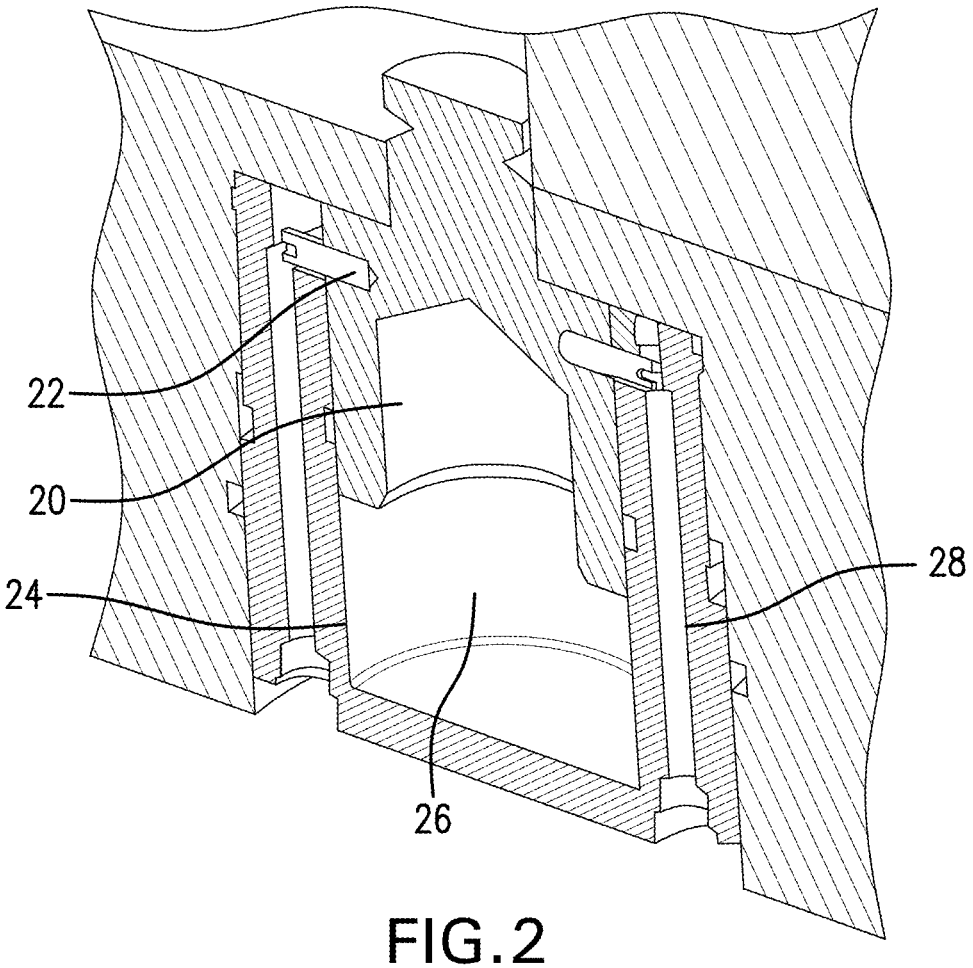
FIG. 2 is an enlarged view of a portion of FIG. 1 illustrating the activation piston.

The selective well barrier/bottom 10 comprises a housing 12 with a slip 14 disposed therein such that axial movement of the slip relative to the housing 12 causes the slip to move radially outwardly while moving axially in order to come into contact with a tubular radially outwardly disposed of the housing 12. For the purposes of this application, reference to a tubular radially outwardly disposed of the housing is intended to include a tubing string, casing, or open hole. The slip 14 is moved via a drive bar 16 disposed within the housing 12 and moves due to the bias of a biaser 18 under conditions where the drive bar 16 is permitted to move. The drive bar 16 is prevented from moving by an activation piston 20 (See FIGS. 1 and 2) that is responsive to annular hydraulic pressure (the term as used herein meaning applied or hydrostatic pressure) at a preset threshold. At the threshold, a piston shear pin 22 (or other release mechanism) is sheared and the activation piston will retreat into its piston housing 24, wherein an atmospheric chamber 26 is defined. The piston housing 24 further defines pressure pathways 28 that are open to annular pressure and port that pressure to the activation piston to cause the retreat at the threshold pressure. Further present on the housing 12 are centralizers 30 and a seal 32. Both the centralizers 30 and seal 32 are meant to make contact with the radially outwardly disposed tubular to centralize the well barrier/bottom 10 and seal the well barrier/bottom 10 to the radially outwardly disposed tubular, respectively. The seal 32 provides for a hydraulic stop that allows pressuring up in the annulus uphole of the selective well barrier/bottom 10 rather than attempting to pressurize the entire well. In an embodiment the seal is a swab element. In the drawing the element is illustrated as a cup. One of ordinary skill in this art will appreciate that a swab cup disposed as stated and illustrated on a device that must move within the borehole would be undesirable in the ordinary course but in the present disclosure, the well barrier/bottom 10 further includes a number of features that facilitate flow bypass and are collectively referred to herein as a flow bypass arrangement 34.

Figure 3:
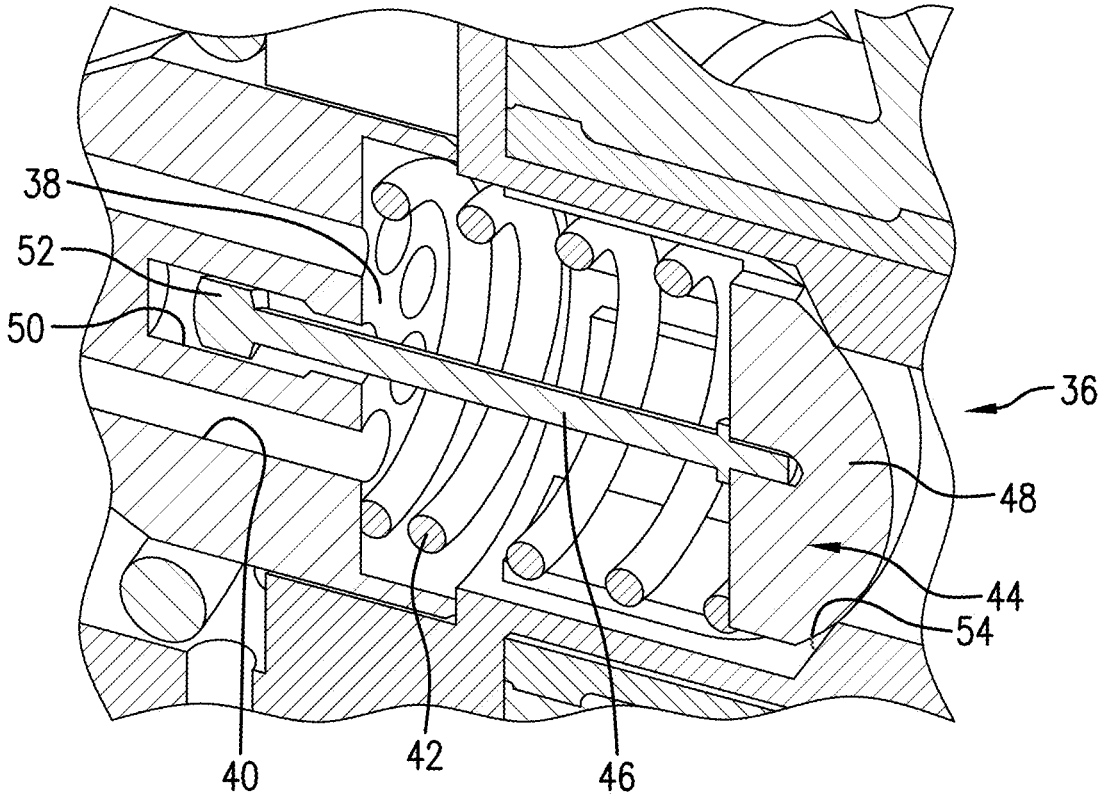
FIG. 3 is another enlarged view of a portion of FIG. 1 illustrating a check valve.

In an embodiment, the flow bypass arrangement 34 includes a check valve while in another the arrangement 34 includes a flapper valve. The latter will be discussed later in this document. Referring still to FIG. 1, the check valve 36 embodiment is illustrated. At an end 38 of the drive bar 16, one or more ports 40 (visible in FIG. 1 but better viewed in FIGS. 3 and 4) are disposed to allow fluid flow. Also, at the end 38, a poppet spring 42 is disposed about a poppet 44. Poppet 44 includes a body 46 that extends from a poppet head 48 into a receptacle 50 of the drive bar 16. A flare 52 of the body 46 is of larger dimension radially than the receptacle 50 in the end 38 so that the poppet 44 is limited in is outward movement, under the bias of the poppet spring 42, as well as being limited in inward movement of the poppet 44 against the bias of spring 42. It will be appreciated that the poppet head 48 seals against a valve seat 54 under the bias of poppet spring 44 when the drive bar 16 is in the unreleased condition shown in FIG. 1. In this condition, the poppet 44 can be forced off the seat 54 by fluid pressure from downhole of the well barrier/bottom 10 (from the right in the figure). This means that fluid trapped downhole of the selective well barrier/bottom 10 by seal 32, while the selective well barrier/bottom 10 is traveling in the downhole direction, may escape through the check valve 36. The escape of fluid ensures that fluid pressure downhole of the selective well barrier/bottom 10 does not damage the formation or impede downhole direction progress of the selective well barrier/bottom 10.

Figure 4:
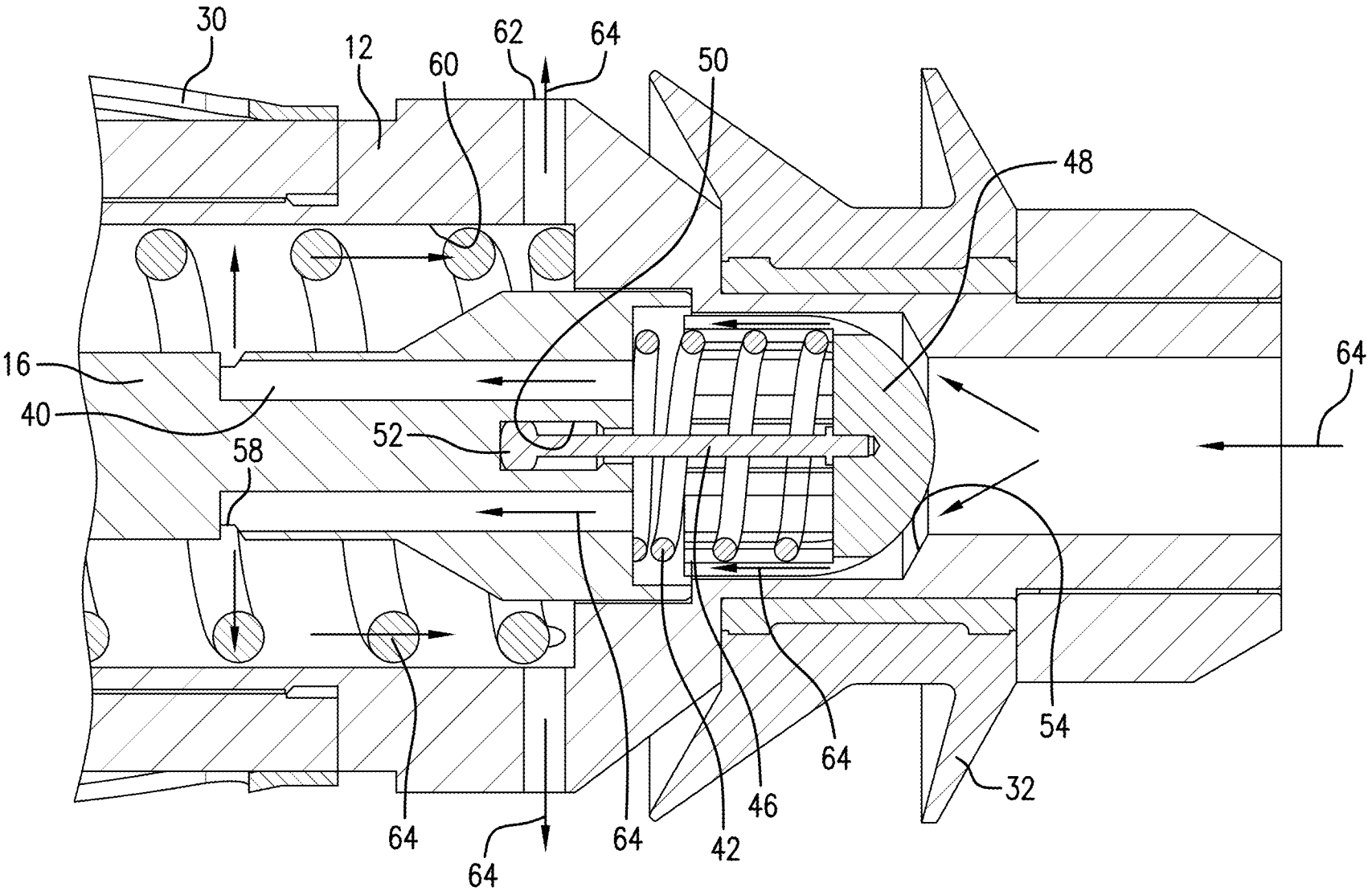
FIG. 4 is a sectional view of a portion of the selective well barrier/bottom illustrating a fluid flow path from downhole of the selective well barrier/bottom.

Referring to FIG. 4, the flow path past the check valve 36 is illustrated. Pressure from downhole (right in Figure) forces the poppet 44 off the seat 54, compressing poppet spring 42 and shifting flare 52 deeper into receptacle 50. The flow traverses the ports 40 to exit the drive bar 16 at bar outlets 58 into a biaser cavity 60 and then through housing openings 62. The flow path is marked by arrows 64. It will be appreciated that the housing openings 62 are uphole of the seal 32 while the pressure source is downhole of the seal 32. Accordingly, the flow bypass arrangement 34 effectively allows fluid to flow from a downhole side of the seal 32 to an uphole side of the seal 32. This allows the well barrier/bottom 10 to be conveyed into a borehole full of fluid and still make progress without damaging the formation, creating surge pressures or by having its forward progress inhibited. Yet, the well barrier/bottom 10 will at the same time hold pressure applied annularly from the uphole direction (left of the figure), thereby allowing the selective well barrier/bottom 10 to be hydraulically set. A tool attached to the well barrier/bottom 10 can be hydraulically set even though there is no well barrier in place before running or the well bottom is not near, or may be mechanically set if the well barrier/bottom 10 is anchored.

Figure 5:
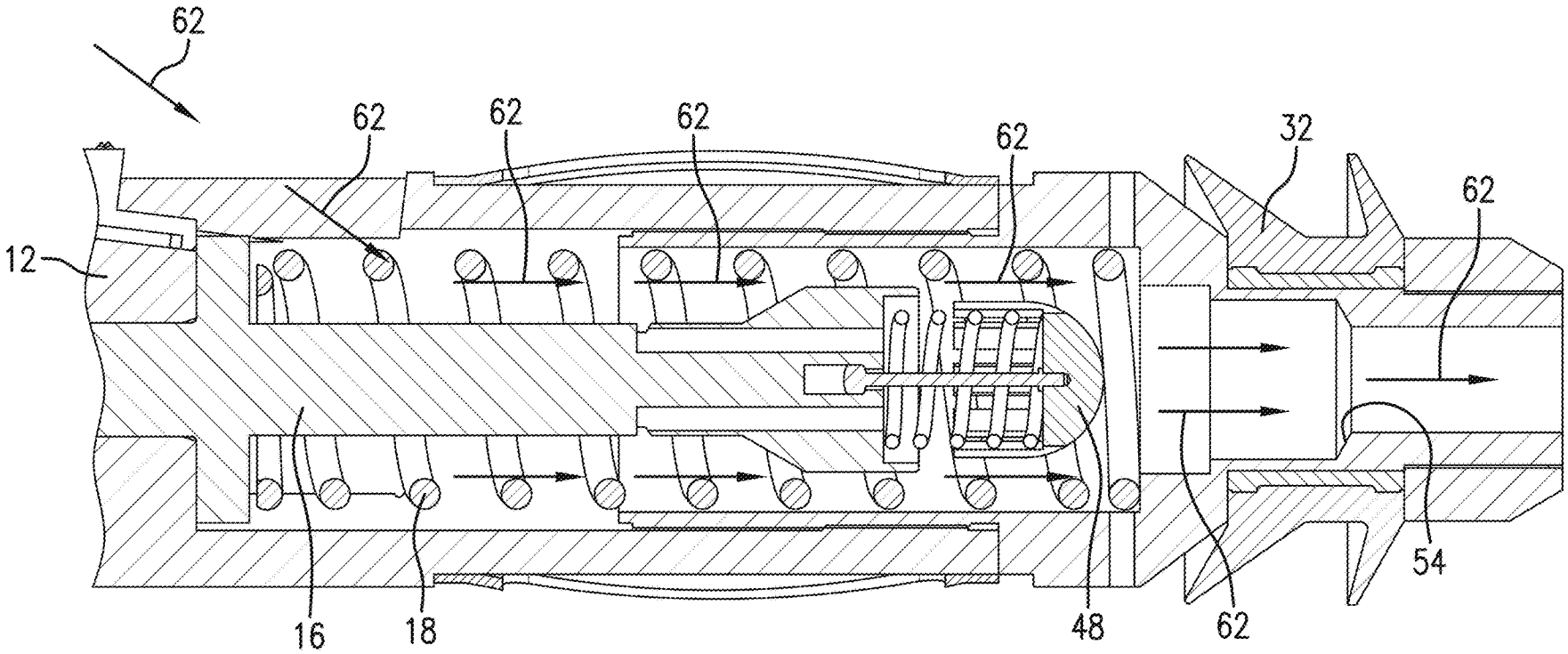
FIG. 5 is a sectional view of a portion of the selective well barrier/bottom illustrating a fluid flow path from uphole of the selective well barrier/bottom.

The selective well barrier/bottom 10 may also be set as an anchor for a selective "bottom" as mentioned above, by using hydraulic pressure in the annulus against the seal 32 to set the well barrier/bottom 10 in a desired location. Upon applied pressure in the annular space uphole the well barrier/bottom 10 reaching a threshold (against seal 32), the activation piston will release the drive bar 16 and the biaser 18 will expand, pushing the drive bar 16 into the slip 14 to cause the slip to move into contact with the radially outwardly disposed tubular. Set down weight will then solidly set the slip 14 and cause the well barrier/bottom 10 to be a solid anchor. In this condition, and referring to FIG. 5, it will be appreciated that the poppet 44 has moved, pursuant to movement of the drive bar 16, off of the seat 54 and is in this condition open to flow in either direction thereacross. The flow of fluid from uphole of the well barrier/bottom 10 can now proceed through the well barrier/bottom 10 as illustrated with arrows 64, giving circulation back to the operator. This also allows for easier retrieval of the selective well barrier/bottom 10 when such retrieval is desired, and overpull has unsupported the slip 14, since one need not lift the annular column of fluid uphole of the seal 32 but rather allow that fluid to flow through the selective well barrier/bottom 10.

It is to be appreciated that although there is flow through the tool pursuant to the check valve 36 being physically displaced from the seat 54 by drive bar 16 movement, hydraulically actuated tools uphole of the selective well barrier/bottom 10 can still be set hydraulically because the selective well barrier/bottom 10 represents a restriction to flow and hence will produce a pressure drop thereacross. Increasing a flow rate from uphole toward the selective well barrier/bottom 10, will result in pressure increasing uphole of the tool. Threshold pressures are therefore reachable through flow rate manipulation.

Figure 6:
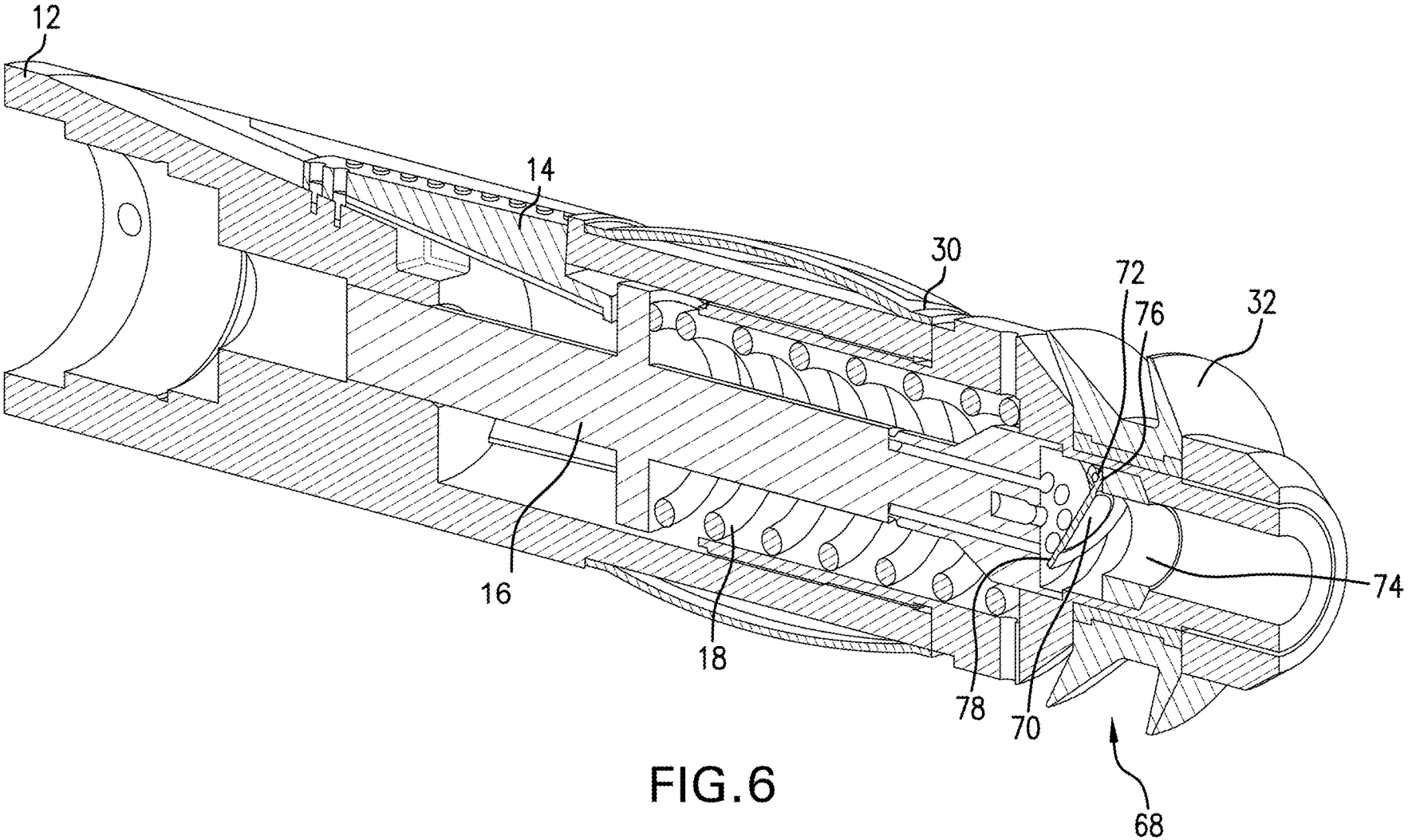
FIG. 6 is a perspective cross sectional view of another embodiment of the selective well barrier/bottom employing a flapper valve.
Figure 7:
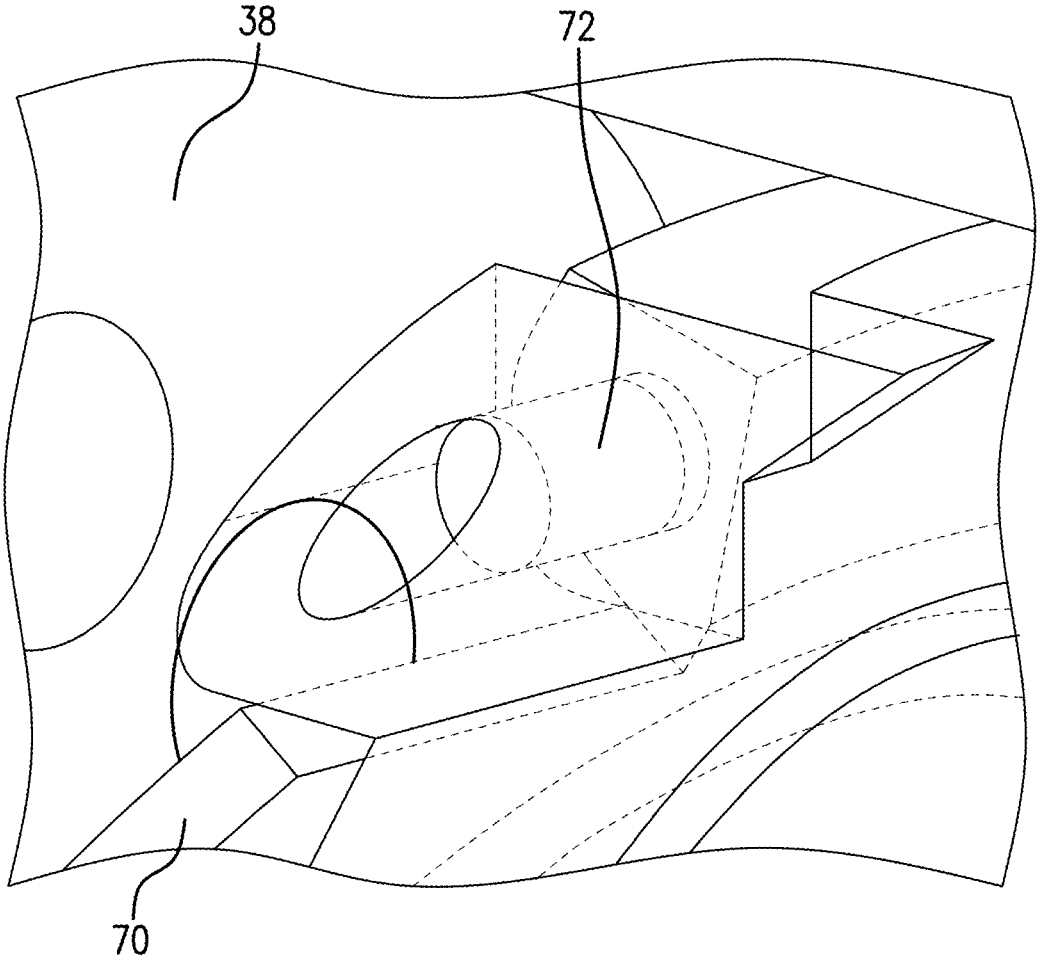
FIG. 7 is an enlarged views of a portion of FIG. 6, illustrating the releasable nature of the pin of the flapper valve.
Figure 8:
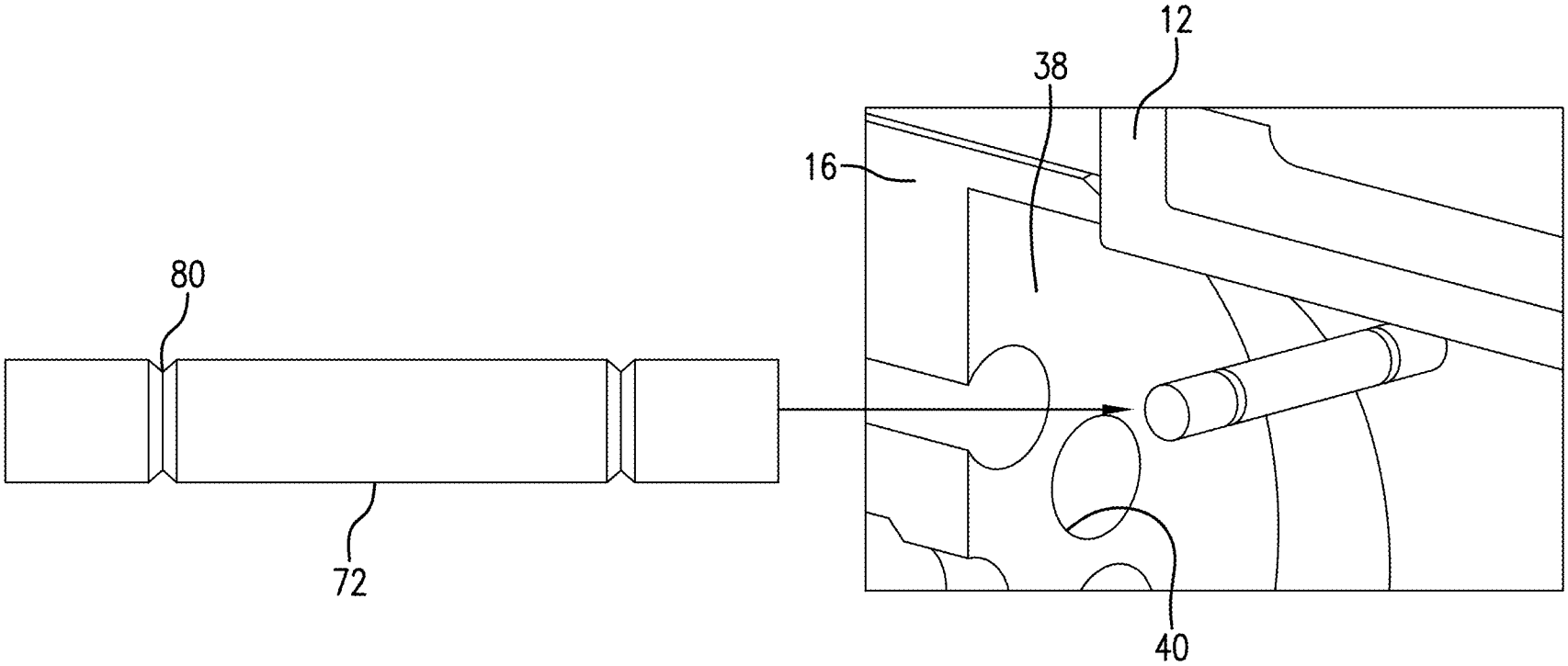
FIG. 8 is the view of FIG. 7 but removing from view the flapper so that the pin can be seen and then the pin is also exploded out to provide clarity.

Referring to FIG. 6, an alternate embodiment of the selective well barrier/bottom 10 that was mentioned above is illustrated. In this embodiment the flow bypass feature 34 includes a flapper valve 68 including a flapper 70 that is articulated to the housing 12 at a pin 72 and is biased to a closed position against a flapper seat 74 by torsion spring 76. Flapper 70 may be forced off seat 74 in the same manner as poppet head 48 is forced off the seat 54 in the previously discussed embodiment, by fluid pressure extant downhole of the selective well barrier/bottom 10. For the regaining of circulation as well as ease of retrieval of the flapper valve embodiment, a tether 78 is disposed between the flapper 70 and the end 38 of the drive bar 16 so that when the drive bar 16 is permitted to move based upon the activation piston retreating and the biaser 18 releasing its potential energy, the flapper 70 will be held open. Further, in an embodiment, the tether 78 is made shorter than the stroke length of the drive bar 16 and the pin 72 is configured to shear or otherwise fail so that the flapper 70 is itself displaced from the flapper seat 74 entirely. The nature of the pin 72 in such embodiment is illustrated in FIGS. 7 and 8. In FIG. 7, the flapper 70 is illustrated with the pin 72 in place. In this view, the pin 72 is an optional pin that is configured to release. One embodiment of this optional pin is that it has grooves 80 that will facilitate shearing of the pin 72 upon load, that load coming from the shorter tether in this embodiment. In all other respects the flapper valve embodiment works in the same way as the check valve embodiment and provides all of the same benefits to the industry.

Figure 9:
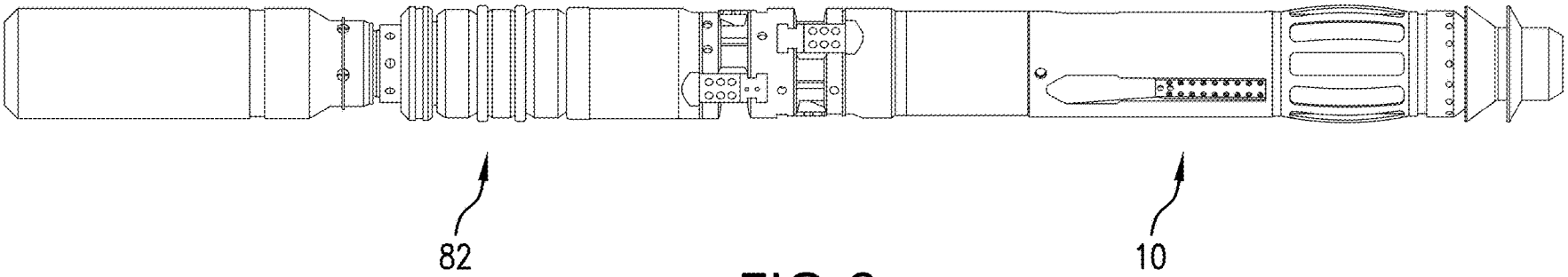
FIG. 9 is a side view of a combination of a separate tool and the selective well barrier/bottom.

In operation, the selective well barrier/bottom 10 is connected to a conveyance string either immediately downhole of another tool or may be connected directly to the tool (see FIG. 9). As illustrated, a packer 82 is connected directly to the selective well barrier/bottom 10. The entirety of the illustration of FIG. 9 would be run into a borehole (cased, open, etc.). Tools in the illustrated position of tool 82 may be hydraulically actuated by pressuring up on the annulus against the seal 32 or may be mechanically actuated by setting down weight on the selective well barrier/bottom 10 after hydraulic actuation of selective well barrier/bottom 10 whereby the selective well barrier/bottom 10 becomes a mechanical anchor when the slip 14 is driven into the radially outwardly disposed tubular. Tool 82 may then be mechanically set by set down weight or still may be hydraulically set due to flow restriction through the selective well barrier/bottom 10 facilitating the building of pressure to set tool 82.

Figure 10:
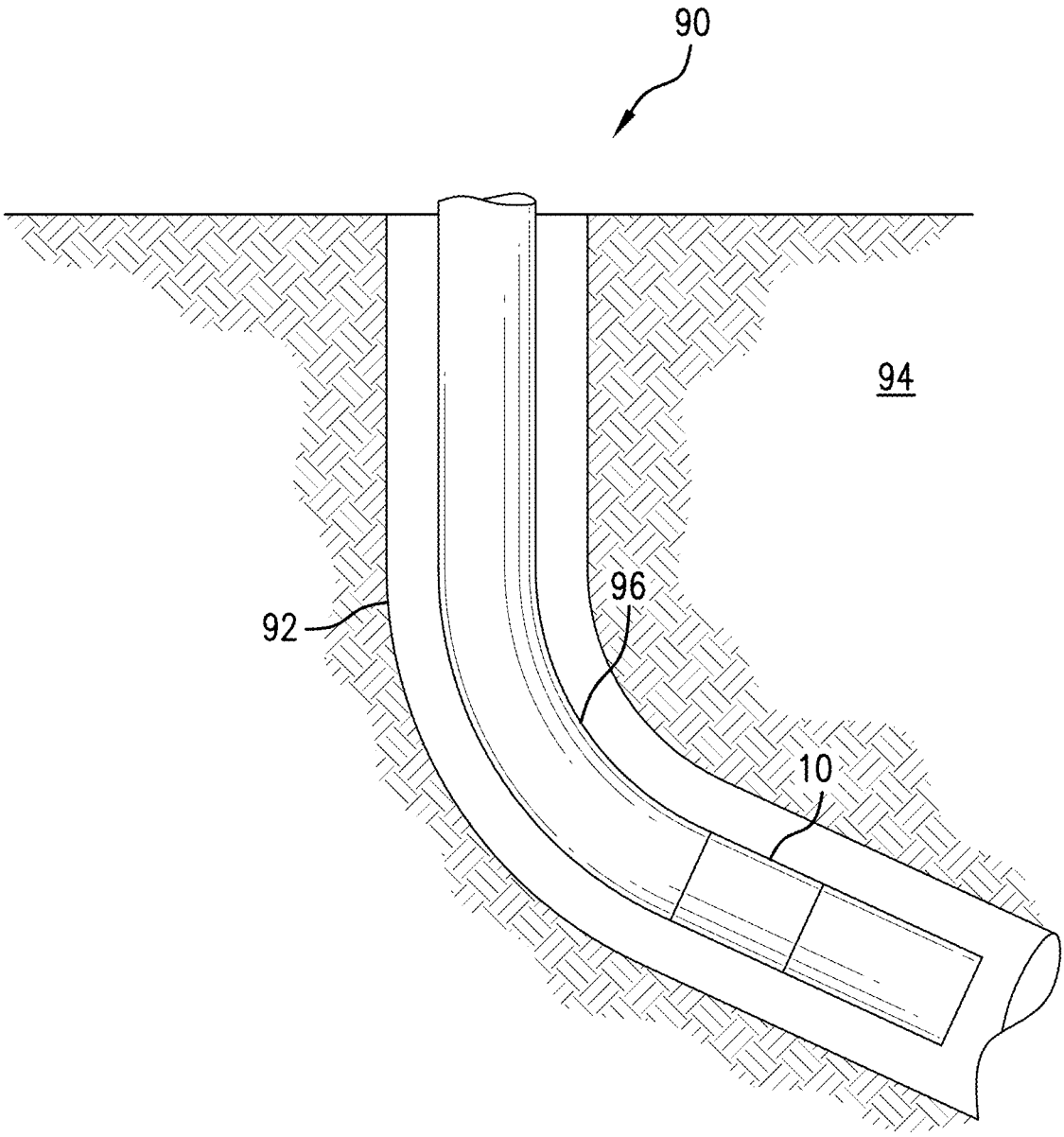
FIG. 10 is a view of a borehole system including the selective well barrier/bottom as disclosed herein.

Referring to FIG. 10, a borehole system 90 is illustrated. The system 90 comprises a borehole 92 in a subsurface formation 94. A string 96 is disposed within the borehole 92. A selective well barrier/bottom 10 as disclosed herein is disposed within or as a part of the string 96.

The well barrier/bottom 10 as described herein is extraordinarily beneficial to the art in that tools that have traditionally required a well barrier/bottom could not heretofore be efficiently operated unless a well barrier had been installed or the bottom of the well were within reach for a mechanical set down on that bottom. The selective well barrier/bottom 10 affords the operator the latitude to temporarily (or permanently, if desired) create an analog of a well barrier or well bottom wherever the operator may want such structure. Due to the seal 32, there is a well barrier wherever the seal is located against which hydraulic pressure may be built without the losses and potential formation damage that is inherent in borehole systems where there is a fluid pathway for flowing into the formation. Further, the well barrier/bottom 10, facilitates the use of hydraulic tools or mechanical tools at a desired location since both types of tools can be operated using the well barrier/bottom 10. The well barrier/bottom 10 can be anchored upon annulus pressure and then provide the hard stop needed for mechanical actuations (set down weight) for tools uphole of the well barrier/bottom 10. Mechanical tools (packers, open hole anchors, spears, etc.) are accordingly settable anywhere in the borehole system. Further, tools that heretofore required hydraulic valves that can be expensive and more likely to experience malfunctions, may have those hydraulic valves completely eliminated, thereby making tools less expensive to build and more reliable because the well barrier/bottom 10 presents a mechanical set down opportunity. Finally, the well barrier/bottom 10 is employable in both open and cased holes.

Set forth below are some embodiments of the foregoing disclosure:

Embodiment 1: A selective well barrier/bottom, including a housing, a slip operably disposed in the housing, a drive bar in operable contact with the slip, a biaser disposed between the housing and the drive bar, a seal disposed on the housing to radially seal with a tubular radially outwardly of the housing, and a flow bypass arrangement disposed to facilitate flow past the seal.

Embodiment 2: The selective well barrier/bottom as in any prior embodiment, wherein the seal is a swab element.

Embodiment 3: The selective well barrier/bottom as in any prior embodiment, wherein the flow bypass flow arrangement includes a check valve.

Embodiment 4: The selective well barrier/bottom as in any prior embodiment, wherein the check valve is movable with the drive bar.

Embodiment 5: The selective well barrier/bottom as in any prior embodiment, wherein the flow bypass arrangement includes a flapper valve.

Embodiment 6: The selective well barrier/bottom as in any prior embodiment, wherein a flapper of the flapper valve is tethered to the drive bar.

Embodiment 7: The selective well barrier/bottom as in any prior embodiment, wherein the housing includes a seat and the drive bar includes a check valve.

Embodiment 8: The selective well barrier/bottom as in any prior embodiment, wherein the check valve comprises a poppet, a poppet spring, and a poppet body.

Embodiment 9: The selective well barrier/bottom as in any prior embodiment, wherein the poppet body further includes a flare that interacts with the drive bar to limit stroke of the poppet.

Embodiment 10: The selective well barrier/bottom as in any prior embodiment, wherein the flow bypass arrangement is configured to alleviate surge pressure when running into a borehole.

Embodiment 11: The selective well barrier/bottom as in any prior embodiment, wherein the flow bypass arrangement is configured to pass flow from uphole of the well barrier/bottom when anchored in a borehole.

Embodiment 12: The selective well barrier/bottom as in any prior embodiment, wherein the flow bypass arrangement is configured to pass flow while pulling out of a borehole.

Embodiment 13: A borehole configuration to convert a hydraulically settable downhole tool to a mechanically settable downhole tool, the arrangement including a seal disposed to span an annular space about the configuration and contact a radially outwardly disposed tubular, a flow bypass arrangement configured to allow fluid flow through the configuration and to bypass the seal.

Embodiment 14: The configuration as in any prior embodiment, the configuration supplying a hydraulic support structure.

Embodiment 15: A method for setting a tool in a borehole including fitting the selective well barrier/bottom as in any prior embodiment to the tool, and setting the tool with one of applied hydraulic pressure against the seal or set down weight against the selective well barrier/bottom.

Embodiment 16: A method for constructing a borehole system including running into the borehole system with a selective well barrier/bottom as in any prior embodiment, actuating the selective well barrier/bottom with hydraulic pressure applied against the seal, actuating another tool in the borehole by applying hydraulic pressure against the seal or setting weight down on the selective well barrier/bottom.

Embodiment 17: The method as in any prior embodiment, further comprising supplying a backup mechanical actuation stop for the another tool.

Embodiment 18: The method as in any prior embodiment, further comprising conserving hydraulic fluid in the borehole annulus with the seal.

Embodiment 19: A borehole system, including a borehole in a subsurface formation, a selective well barrier/bottom as in any prior embodiment, disposed within the borehole.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A selective well barrier/bottom, comprising:
a housing;
a slip operably disposed in the housing;
a drive bar in operable contact with the slip;
a biaser disposed between the housing and the drive bar;
a seal disposed on the housing to radially seal with a tubular radially outwardly of the housing, wherein the seal is a swab element; and
a flow bypass arrangement disposed to facilitate flow past the seal.

2. The selective well barrier/bottom as claimed in claim 1, wherein the flow bypass flow arrangement includes a check valve.

3. The selective well barrier/bottom as claimed in claim 1, wherein the check valve is movable with the drive bar.

4. The selective well barrier/bottom as claimed in claim 1, wherein the flow bypass arrangement includes a flapper valve.

5. The selective well barrier/bottom as claimed in claim 4, wherein a flapper of the flapper valve is tethered to the drive bar.

6. The selective well barrier/bottom as claimed in claim 1, wherein the housing includes a seat and the drive bar includes a check valve.

7. The selective well barrier/bottom as claimed in claim 6, wherein the check valve comprises a poppet, a poppet spring, and a poppet body.

8. The selective well barrier/bottom as claimed in claim 7, wherein the poppet body further includes a flare that interacts with the drive bar to limit stroke of the poppet.

9. The selective well barrier/bottom as claimed in claim 1, wherein the flow bypass arrangement is configured to alleviate surge pressure when running into a borehole.

10. The selective well barrier/bottom as claimed in claim 1, wherein the flow bypass arrangement is configured to pass flow from uphole of the well barrier/bottom when anchored in a borehole.

11. The selective well barrier/bottom as claimed in claim 1, wherein the flow bypass arrangement is configured to pass flow while pulling out of a borehole.

12. A method for setting a tool in a borehole comprising:
fitting the selective well barrier/bottom as claimed in claim 1 to the tool; and
setting the tool with one of applied hydraulic pressure against the seal or set down weight against the selective well barrier/bottom.

13. A method for constructing a borehole system comprising:
running into the borehole system with a selective well barrier/bottom comprising:
a housing;
a slip operably disposed in the housing;
a drive bar in operable contact with the slip;
a biaser disposed between the housing and the drive bar;
seal disposed on the housing to radially seal with a tubular radially outwardly of the housing; and
a flow bypass arrangement disposed to facilitate flow past the seal;
actuating the selective well barrier/bottom with hydraulic pressure applied against the seal;
actuating another tool in the borehole by applying hydraulic pressure against the seal or setting weight down on the selective well barrier/bottom; and
conserving hydraulic fluid in the borehole annulus with the seal.

14. The method as claimed in claim 13, further comprising supplying a backup mechanical actuation stop for the another tool.

15. A borehole system, comprising:
a borehole in a subsurface formation;
a selective well barrier/bottom as claimed in claim 1, disposed within the borehole.

* * * * *